United States Patent [19]

Walton et al.

[11] 3,975,806

[45] Aug. 24, 1976

[54] APPARATUS FOR COMPRESSIVELY TREATING FLEXIBLE SHEET MATERIALS

[76] Inventors: Richard Rhodes Walton, 10 W. Hill Place, Boston, Mass. 21450; George Ernest Munchbach, 26 June St., Roslindale, Mass. 02131

[22] Filed: Aug. 14, 1974

[21] Appl. No.: 497,314

Related U.S. Application Data

[60] Division of Ser. No. 330,176, Feb. 7, 1973, Pat. No. 3,869,768, which is a continuation-in-part of Ser. No. 115,606, Feb. 16, 1971, Pat. No. 3,810,280.

[52] U.S. Cl. ..... 26/18.6

[51] Int. Cl.[2] ..... D06C 21/00

[58] Field of Search ..... 26/18.6; 162/111, 280, 162/361; 264/282

[56] References Cited

UNITED STATES PATENTS

| | | | |
|---|---|---|---|
| 2,263,712 | 11/1941 | Wrigley et al. | 26/18.6 |
| 2,765,513 | 10/1956 | Walton | 26/18.6 |
| 2,765,514 | 10/1956 | Walton | 26/18.6 |
| 3,260,778 | 7/1966 | Walton | 264/282 |
| 3,452,409 | 7/1969 | Trifunovic et al. | 26/18.6 |
| 3,597,814 | 8/1971 | Trifunovic et al. | 26/18.6 |
| 3,681,819 | 8/1972 | Trifunovic et al. | 26/18.6 |

*Primary Examiner*—Robert R. Mackey
*Attorney, Agent, or Firm*—W. R. Hulbert

[57] ABSTRACT

Apparatus for initiating compressive treatment of a running length of flexible material wherein the material is confined against a moving drive surface by a confining surface and then retarded by a retarding surface located downstream of the confining surface and spaced from the drive surface. The material is pressed into driven engagement with the drive surface by pressing the confining surface against it while maintaining the retarding surface in ineffective position. The retarding surface is movable toward the drive surface to increase the retarding effect until satisfactory running condition is achieved. The thus pressed confining surface may be shifted upstream while the retarding surface is shifted to engage the material in the region vacated by the confining surface.

16 Claims, 12 Drawing Figures

FIG 10
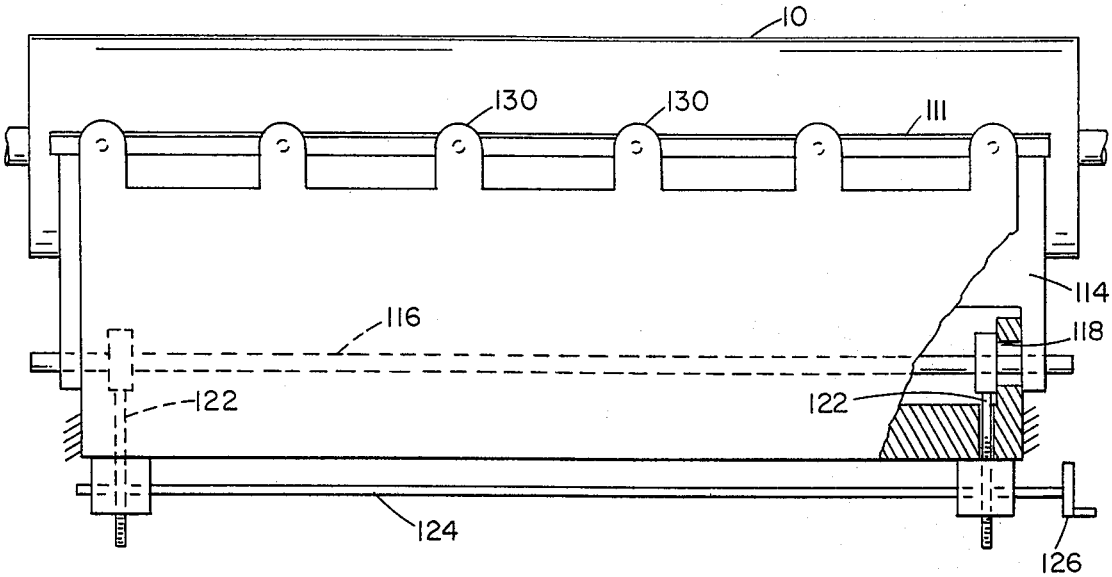
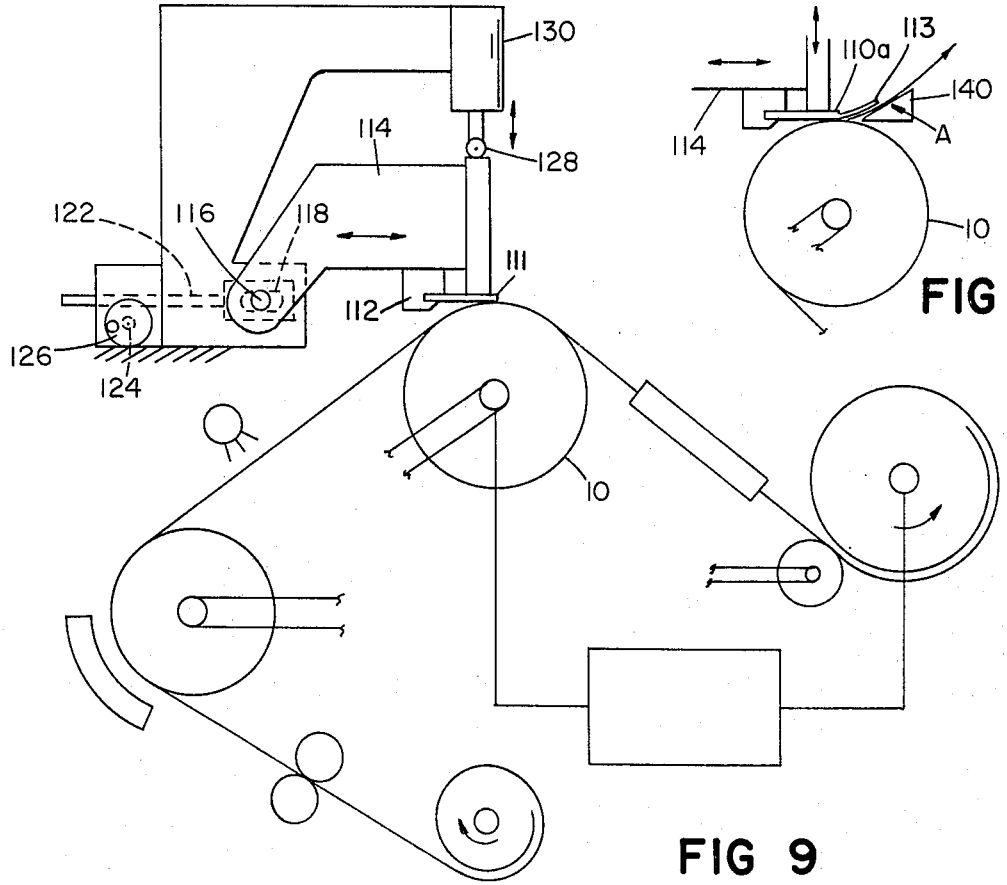
FIG 11
FIG 9

APPARATUS FOR COMPRESSIVELY TREATING FLEXIBLE SHEET MATERIALS

This application is a division of U.S. Patent Application Ser. No. 330,176 filed Feb. 7, 1973, now U.S. Pat. No. 3,869,768, issued Mar. 11, 1975, which was, in turn, a continuation-in-part of U.S. Patent Application Ser. No. 115,606 filed Feb. 16, 1971, now U.S. Pat. No. 3,810,280, issued May 14, 1974.

This invention relates to longitudinal treatment of thin materials, especially materials formed of fibers, for the purpose of rearranging the constituents of the materials, e.g. to increase bulk or to soften such material as nylon tricot and non-woven fabrics or to make woven goods stretchy.

The principle of feeding a thin material against a retarding means (quite old) has been limited in practice due to control and stability problems. In particular the start-up and adjustment of such treatment has been difficult and time consuming.

One of the previously unsuccessful approaches to this problem (that of confining the material against a drive surface and on the same side of the material as the confining surface engaging it with a retarding surface) is here utilized with important new features which solve these problems.

According to the invention, we provide an improvement in apparatus for establishing a continuous longitudinal compressive treatment of a running length of flexible material by pressing it by means of a pressing assembly into driven engagement with a moving drive surface, the pressing assembly providing a confining surface and a retarding surface both opposed to the drive surface and the retarding surface positioned beyond the confining surface so that the material passes between the retarding and drive surfaces after it exits from beneath the confining surface, and wherein the pressing assembly comprises (1) a presser member and (2) coupling means for transmitting the force of the presser member to the material, and the coupling means comprises (1) confining means defining the confining surface, (2) retarding means postioned at least in part beyond the confining means and defining the retarding surface and (3) force transmitting means between the presser member and the confining and retarding means. The novel improvement consists in that the presser member and coupling means are mounted for movement relative to each other longitudinally of the moving drive surface, means are provided for effecting such relative movement while said presser member is in pressing engagement with said coupling means, and the coupling mens are so disposed and arranged with respect to the presser member as, during such relative movement in one directon, progressively to force the retarding surface closer to the moving drive surface from a relatively remote, ineffective position to positions closer to such surface to increase progressively the retarding effect of the retarding surface on a material driven by the drive surface, and, during this same relative movement, to transmit sufficient force to the confining surface to maintain material beneath it in non-slipping, driven engagement with the drive surface to the vicinity of the commencement of the retarding surface.

For treating textiles and similar soft fabrics the material is caused to travel with the drive surface without slippage to a point close to but under the confining surface, in advance of the point where the retarding surface begins. Between these points (generally less than an inch, and in the case of thin fabrics, less than ¼ inch) the material is slippably confined to a restricted thickness. Delivery by the drive surface to the first point forces the material to immediately compress in its own plane against a confined column of compressed material prior to reaching the retarding surface.

In preferred embodiments the retarding surface is inextensible and after adjustment is fixed in the direction of travel of the material; on the other hand it is preferably resiliently yieldable in the direction of thickness of the material. Preferably the retarding surface is comprised of a multiplicity of material gripping projections having an aggregate retarding effect (e.g. hard grit grains bonded to a non-extensible backing sheet or projections of hard metal).

Preferably, also, all portions of the retarding surface are spaced from the drive surface as far as is the first effective retarding portion and a distance greater than the confining surface; a resilient backing layer lies over both a retarder layer member and a layer member defining the confining surface; a sheet form metal member acting face-wise presses the retarding and confining surfaces toward the drive surface; and the retarding surface is resiliently conformed to the form of a cylindrical drive surface.

In one preferred embodiment the presser member which moves tangentially achieves this relative movement independently of the coupling means, over which it moves and against which it presses.

In another preferred embodiment the confining means is mounted for movement rearwardly, counter to the direction of travel of the material, and the retarding means moves into the region vacated by the confining surface, into retarding relation to the material. Preferably in this arrangement the confining and retarding surfaces lie in substantially parallel planes, the plane of the confining surface being closer to the drive surface, with the confining surface in its initial position extending beyond the point of tangency to the drive surface. Also preferably in such embodiments a pressing plate presses the surfaces toward the drive surface, and the coupling means is movable rearward to move the beginning point of the retarding surface toward the point of tangency. Preferably in such coupling means an elastomeric layer is disposed between the pressing plate and the confining and retarding means; and also preferably during movement of the coupling means rollers engage the plate, pressing the plate and the confining and retarding means toward the drive surface while simultaneously allowing the entire coupling means to move in the tangential direction.

FIG. 1 is a diagrammatic highly magnified cross-sectional view of a preferred embodiment of a machine for practicing the invention;

FIG. 1*a* is a fragmentary view of a modified pressure member as shown in FIG. 1.

FIGS. 9 and 10 are side and plan views respectively of the overall machine incorporating the operative elements of the embodiment of FIG. 3 and FIG. 11 is a side view similar to part of FIG. 9 of another embodiment of the invention.

Figures 1, 1A:
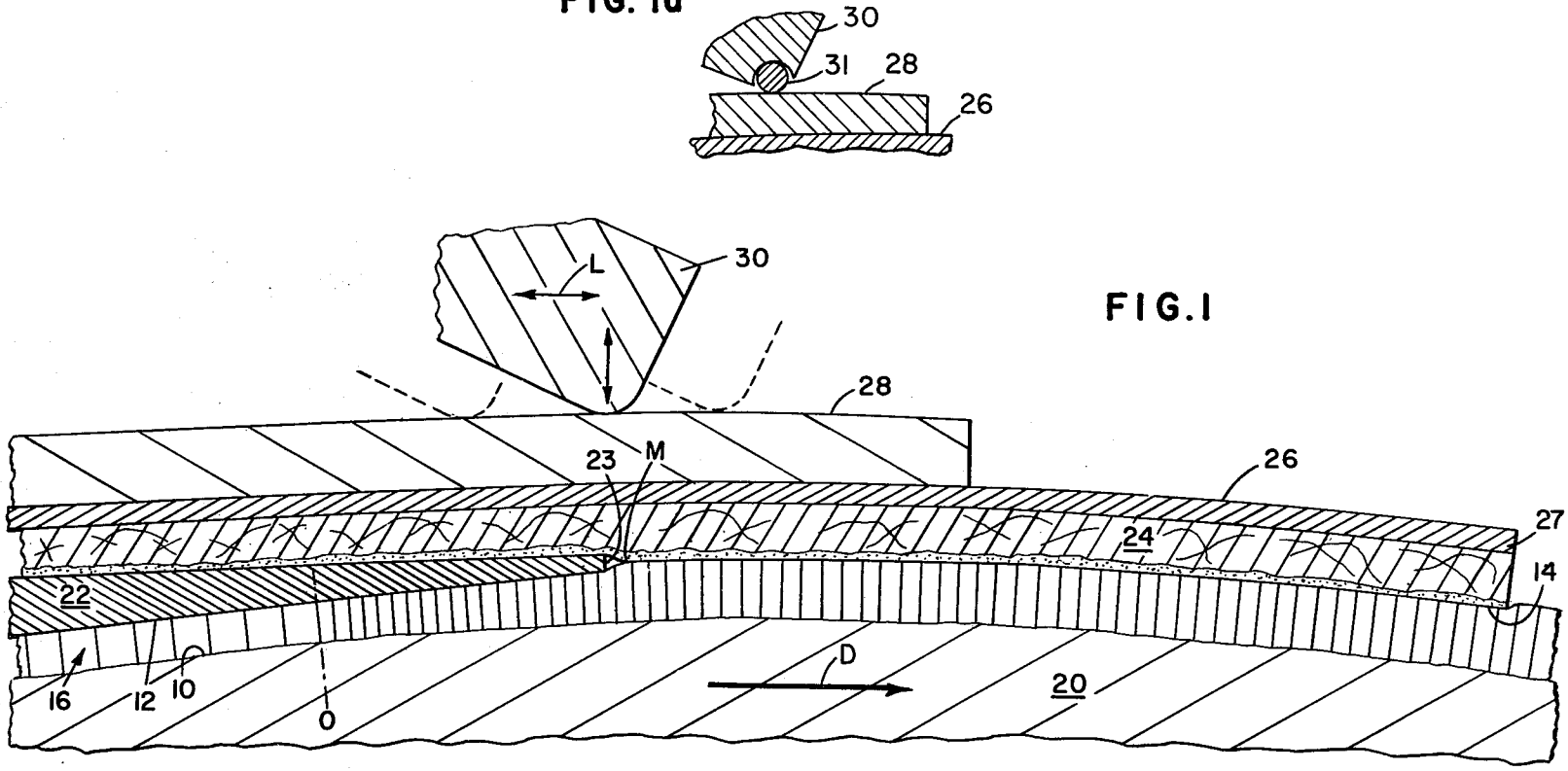

In FIG. 1 drive surface 10 moves, arrow D, beneath fixed confining and retarding surfaces 12 and 14, driving a web of flexible material 16 to be treated. All surfaces have a uniform widthwise extent correspoding to the width of the web to be treated. The degree of magnification is understood from the fact that actual thickness of material 16 is less than 0.015 inch. Drive surface 10 is curved with radius between 2 and 6 inches, though its curvature does not show clearly at the magnification of the drawing. The degree of compression of the material at its various stages is illustrated in a diagrammatic manner in FIG. 1 by the rectangular sections which represent equal masses of material.

The machine is shown in solid lines in running condition after the treatment has stabilized, (the dotted line position of presser member 30 to the left being at start-up position, and the dotted line position at right being a position for increased retarding effect). Confining surface 12 slippably presses material 16 against drive surface 10 to drive it forward in longitudinally uncompressed condition to point 0, the initial point of treatment.

The retarding surface 14 which is rough relative to confining surface 12, begins at M within 1 inch (for textile materials of 0.005 inch to 0.015 inch thickness, within about ¼ inch) of point 0. (In other embodiments, e.g. with stiff materials, the initial point of treatment may be nearly coincident with the initial point of effective retarding surface).

At point 0 uncompressed material is driven and compressed immediately against a column of (temporarily or permanently) compressed material, the latter being slippably confined by the last portion of surface 12. As the material leaves confinement under surface 12, it expands, and is able to remain in its expanded condition throughout its transit under retarding surface 14. Due to the roughness of retarding surface 14, the retarding action can be maintained with light downward pressure. This avoids refeed due to excessive pressure of the web against the drive surface and undue wear of the retarding surface. From point M the retarding surface 14 lies substantially parallel with the drive surface and does not constrict the compressed material or require it to extrude through a minimum passage.

For defining the confining and retarding surfaces a sandwich of fixed layers extends over the roll from a stationary support (not shown, at the left of FIG. 1). This sandwich, which comprises the coupling means for transmitting the force of the presser member 30 to the material 16, comprises primary member 22 defining confining surface 12, a nonresilient fabric 24 having a coated grit facing (e.g. emery cloth) defining retarding surface 14, and a relatively thick and unyielding keeper sheet 28. A spring steel keeper 26 is inserted between keeper sheet 28 and member 24. The entire sandwich extends as a cantilever. A presser member 30 presses the sandwich toward the roll 20. As indicated by the arrows the presser member is adjustable toward the roll surface to vary its radial pressure and it is adjustable relative to the sandwich back and forth in the lengthwise direction, tangential to roll 20, to vary the point of application. By the latter adjustment the proportion of downward force applied to the confining surface 12 to that applied to retarding surface 14 is variable in an action we refer to as "teeter totter". The forces applied to the confining surface are much greater than those applied to the retarding surface, and an adjustment one way or the other of the presser member of 0.25 inch in the direction of the travel of the material can have a desirable effect in controllably varying the treatment.

In the embodiment of FIG. 1 the primary member 22 is formed from a sheet of Invar metal originally of 0.020 inch thickness, which has been machined with a slope to cause it to taper forwardly from full thickness to end 23 of 0.004 inch over a distance of approximately ¼ inch. The retarding emery coth 24 has an uncompressed thickness of about 0.010 inch, with the rough surface of the emery facing against the top surface of member 22, and the emery extending beyond end 23 a distance e.g. of ⅛ to ⅜ inch depending on the treatment and roughness of the emery chosen. The keeper 26 is a length of spring steel of 0.005 inch thickness, and ½ inch width, bent in the widthwise direction on a radius smaller than the radius of the drive surface, and having its width arranged in the direction of travel of the drive surface.

The spring keeper member 26 maintains the retarding surface in the approximate curvature of the drive surface without at any place permitting the spacing under the retarding surface to narrow down to constrict the column in the region of effective retardation. In fact, with this embodiment, although loading of the pressing edge of presser member 30 may be around 50 pounds per linear inch of presser edge (widthwise of the machine) an operator can easily raise the forward edge 27 of the spring keeper 26 with one finger, illustrating the relatively light downward forces required.

In increasing degree of treatment the following retarding surfaces have been employed in the arrangement of FIG. 1 for treatment of knitted and other textiles. All of these retarding materials being emery cloth sold by Behr Manning of Troy, New York, under the tradename Metalite, have a thickness on the order of 0.010 inch.

| Description | RMS new | RMS in use |
|---|---|---|
| crocus cloth (polishing cloth with fine abrasive grit) | 100–130 | 90–110 |
| 500 J | 200–240 | 170–200 |
| 400 J | 270–300 | 230–270 |
| 320 J | 300–500 | 230–280 |

where RMS refers to surface roughness measured in RMS microinches using, for example, an instrument available from Micrometrical division, Bendix Corporation, under the trademark Profilometer; the numbers appearing in the first column refer to the coarseness of the grit, the lower the number the coarser; and J is a designation employed by Behr Manning to indicate the nature of the backing material which holds the grit.

Durable fabric of essentially inelastic qualities may be used as a retarding surface in certain instances; one such demonstration employed a tightly woven mesh fabric having a Profilimeter reading of 450–650 new, 400–450 used. Other materials having gripping characteristics are for example, thin metal mesh or metal or other hard fiber weave in which the crossing elements form projections; finely perforated dimpled or scratched metal plate with the surface discontinuities at the openings forming surface roughness; in some instances a multiplicity of fixed brush or needle-like projections; a rough-surfaced metal plate having, for instance, tiny tungsten carbide particles adhered thereto through the plasma coating technique or more preferably, the gun shot technique. The latter and emery are preferred.

Although a variety of substances may be used to provide the retarder gripping surface, they must in most instances be essentially non-extensible in the direction of travel of the material for proper action. For many treatments it is essential that the retarder member also be resiliently supported in the direction of the tickness of the material, which helps to obtain a self-adjusting proper geometry. Preferably material gripping projections of hard, wear-resistant material are employed and the retarder surface on which they are carried has an elongation of less than 5% under tensions of 1000 psi.

Where it is desired mainly to bulk or thicken a textile, and not to shorten it, the length of retarding surface 14 is kept short, i.e. ⅛ or 1/16 inch in length, and the thickening occurs at the end of the confining surface 12. The material is subjected to severe shearing forces at its surfaces, causing actual rearward stretching or even localized tearing of the top surface relative to the bottom surface. This results from the bottom surface being engaged by projections of the drive surface which move forward relative to the material, while the retarding surface pulls relatively the other way. These forces and shear distortion cause the material emerging from under such a short extent of retarder to immediately "bloom" into a bulky form.

To commence operation of the embodiment of FIG. 1, the relative tangential position of presser member 30 obviously would be in the left hand dotted position or even further to the left, applying force toward the roll 20 in the direction of the arrows. In such position the retarding surface 14 is relatively ineffective, and confining surface 12 is effective to cause the material 16 to travel with roll 20. The material remains uncompressed in the longitudinal direction, and by following the contour of the roll, will exit from the machine without contacting the retarding surface 14. Once uniform feeding conditions are established in this position presser member 30 can be advanced rightward in the tangential direction (arrow L). As it advances it continues to press confining surface 12 against the roll for driving forward, but it begins also to press retarding surface 14 down toward the roll. A point is reached in which the retarding surface 14 contacts the material 16. The material is then retarded, oncoming material is pressed against it, the material thickens, tending to raise the retarding surface, and at the same time the longitudinally compressed column of material builds back to point 0. This point is established by the relative positions and characteristics of the various surfaces, in particular the position of the confining surface, as well as the nature of the material being treated. It is important to the process that point 0 be kept in the vicinity of the beginning point M of the retarding surface in order to establish stable treatment conditions.

It will be understood that the tangential movement of the presser is far greater than the actual radial movement of the retarding surface during the adjustment, this serving to remove criticality from the treatment and enabling standards to be set which average workmen can attain.

Figure 2:
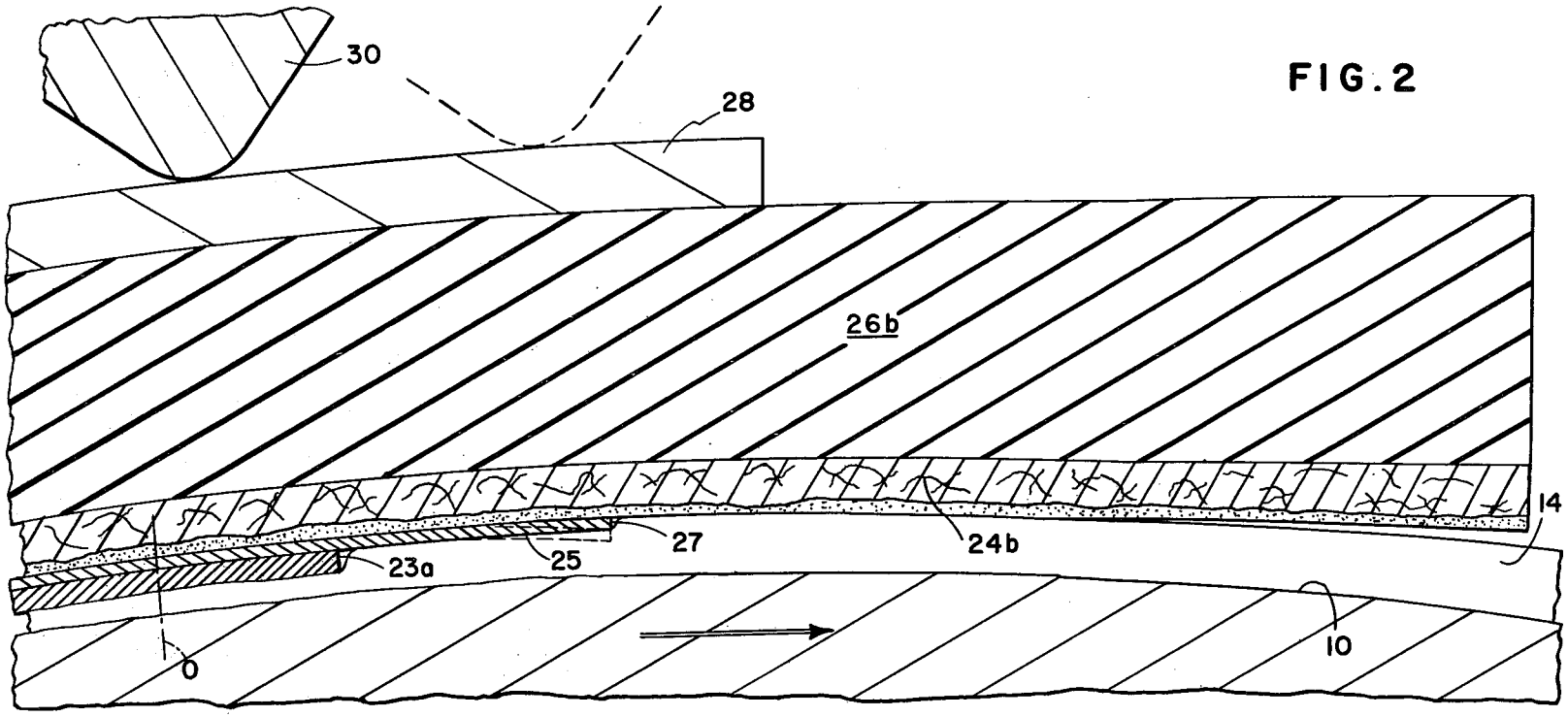
FIG. 2 is a view similar to FIG. 1 of another preferred embodiment.
Figure 3:
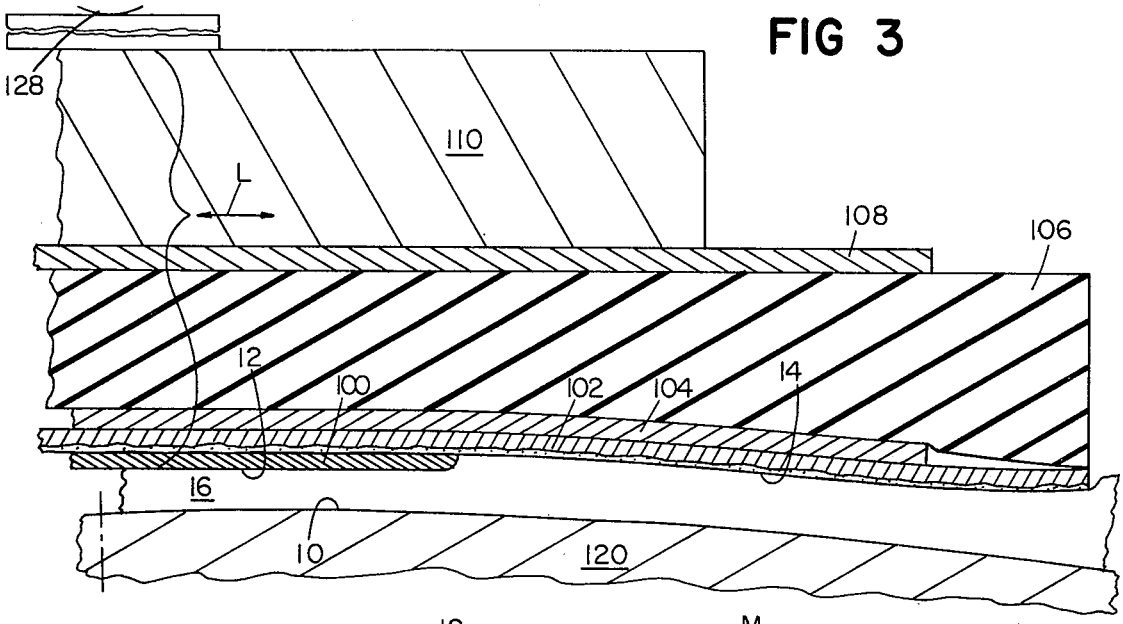
FIG. 3 is a cross-sectional view of another preferred embodiment which includes an assembly which moves tangentially.

In the embodiment of FIG. 2 the rubber **26*b* behind the emery cloth 24*b*** helps conform the emery to the curvature of the drive roll. In cases where the desired effect is to bulk a web, the metal keeper member above the rubber may be very thin, and allow the retarder assembly to flex upwardly. In such instances the portion of the retarding surface nearest the confining surface accomplishes most of the retarding, outward portions serving to buffer the column to ensure uniform treatment across the web width.

In this embodiment two steps of treatment can be accomplished before the material reaches the retarding surface, useful where, as with many knitted fabrics, the material is porous or lose. Densification of the material takes place at initial point 0 preceding the end **23*a* of the primary member, a column of longitudinally compressed but not substantially thickened material extending from point 0 to end 23*a*. A second extension 25 or "roof" of low friction slippable material, invar or Teflon impregnated blue steel, extends forward. The column of material is guided forward by oblique contact with this low friction surface overcoming any tendency to curl upwards; meanwhile the natural tendency for the material to expand in thickness causes the column to fill the volume under roof 25. This thickened column (now having more resistance to bending because of increased thickness) is then projected forward under edge 27** of the roof, and into exposure with the retarding surface, where it further expands and is napped as described above. This device has also demonstrated the capability of bulking nylon tricot, and is particularly effective when used with a knurled drive roll.

The length of the roof for treating nylon tricot is preferably in the range of about 0.030 to 0.080 inches length; with a drive roll of 4 inch diameter, 0.040 inch roof length is preferred, with a roll of 12 inch diameter, 0.060 inch roof length is preferred.

In certain instances it is advantageous to adjust the presser 30 considerably forward. In this case the extension 25 is bent downward (see dotted lines) and causes more densification to occur. In a similar arrangement, but with a much longer extension 25, the extension itself may serve as the primary and define the point of initial treatment, and by this construction a simple throw-away package of emery and extension may be removably inserted between relatively thick permanent members.

In the embodiment of FIGS. 3–10, the coupling means for transmitting force from presser member 128 includes a sandwich comprising a metal sheet member 100 which defines confining surface 12 and a retarding layer 102 which defines retarding surface 14 (of e.g. emery cloth or a metal surface made rough by tungsten carbide particles). Layer 102 has a portion overlying member 100. There follows in overlying relation metal sheet member 104, silicone rubber layer 106, metal sheet member 108, and presser plate 110.

Typical thicknesses are given in the table:

| Element | Inches |
|---|---|
| 100 | .010 |
| 102 | .010 |
| 104 | .006 |
| 106 | ⅛ |
| 108 | .008 |
| 110 | ⅛ |

As indicated by the bracket and as seen in FIGS. 9 and 10, this entire sandwich comprises a sub-assembly 111 capable of moving back and forth in the direction tangent to the top of drive roll 120. It is mounted in holder 112 which extends across the width of the machine, and holder 112 is mounted on rotary arms 114. The arms are pivoted on cross-shaft 116, the latter being slidable horizontally in slot 118. Fore and aft motion is achieved by jacks 122 at both ends of the machine, operated in unison by control shaft 124 and hand wheel 126. By this mechanism operation of hand wheel 126 can move the sub-assembly from starting position in which the treatment cavity corresponds to FIG. 4, successively to geometries shown in FIGS. 5 and 6. During this motion plate 110 moves beneath rollers 128 carried on the ends of vertically acting pneumatic cylinders 130, which press the sub-assembly toward drive surface 10.

Figure 4:
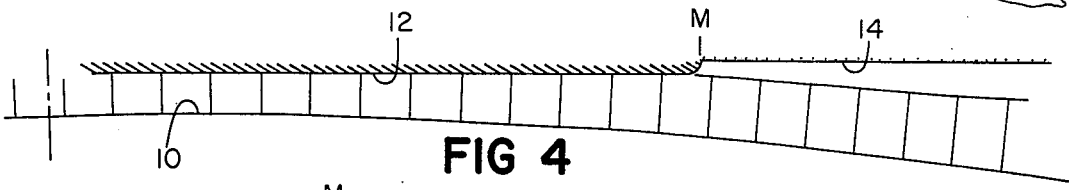
FIGS. 4, 5, 6 and 7 are diagrammatic views illustrating various adjustments of the embodiment of FIG. 3.
Figure 5:
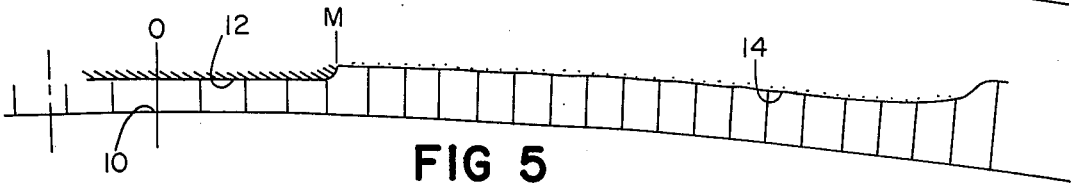
Figure 8:
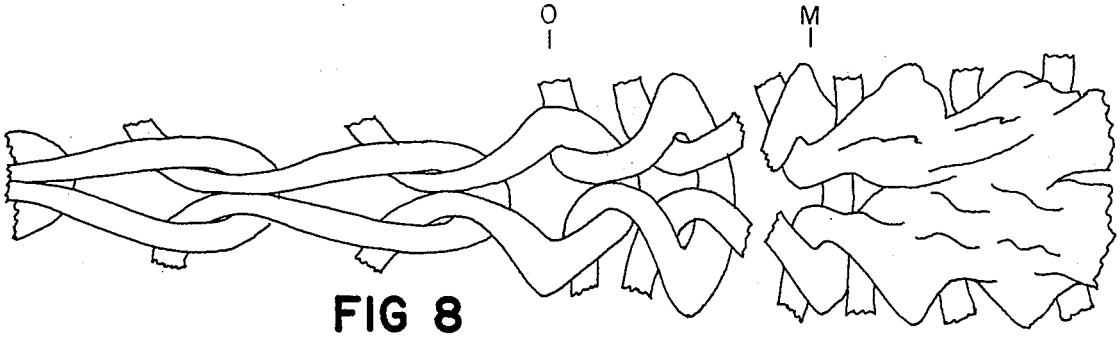
FIG. 8 is a plan view of a fabric at various stages of treatment.

Referring to FIG. 4, at the initial position the confining surface is adjusted to the right, far beyond the tangent point, such that the retarding surface 14 is ineffective. As the material reaches the end of confining surface 12 and the beginning point M of the retarding surface, it has already expanded to its normal thickness. Retarding surface 14 being at a higher plane than surface 10, the material does not touch it. After this position is used to establish steady driving conditions, sub-assembly 111 is moved to the left to establish the geometry of FIG. 5. It will be seen that the movement carries the beginning point M of the retarding surface closer to the point of tangency hence closer to the surface 10 of the roll, to the point where effective retarding has begun. As in the previous embodiments, the downward pressure on the confining surface 12 remains, hence the material travels without slippage on roll surface 10 up to point 0 in the vicinity of (here spaced in advance of) the beginning point M of the retarding surface. Thus compressive treatment of the material occurs. FIG. 8 illustrates the effects of the treatment on nylon tricot.

Figure 6:
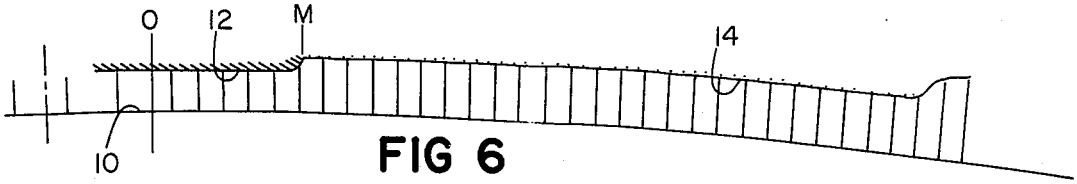

If more severe compression is desired, further movement of the sub-assembly to the position of FIG. 6 is possible.

Figure 7:
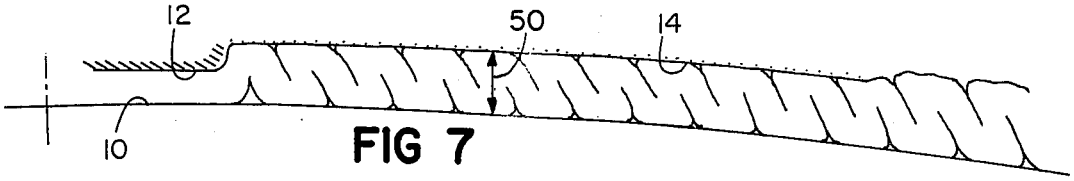

FIG. 7 illustrates the same sub-assembly being used in a creping operation in which the spacing under the retarding surface is sufficient to form a creping cavity 50 for the particular material chosen, e.g. a non-woven fabric.

In these various instances it is important to note the function of the rubber layer 106. Being squeezed between plate 100 and thick, rigid plate 110, it tends to escape where there is no resistance. Thus it has the tendency to bend the forward portion of the retarding layer 102 downwardly about the roll surface, to a condition in which the expansive tendency of the rubber is dissipated (rightward setting of the assembly) or to a condition in which it is countered by the expansive tendency of the compressed material (leftward settings).

According to the embodiment of FIG. 11 a sub-assembly 110*a* which can be identical to sub-assembly 111 of FIG. 9 is provided with a stationary sheet form retarder member 113 projecting forwardly therefrom at an angle in the direction of wide travel. A stationary retarder element 140 is adjusted in the direction of arrow A into an aligned relation with member 113, the two defining an auxiliary retarding passage.

Many implementations of the broader concepts of the invention are possible and are within the scope of the claims. Thus the presser member 30 can be equipped with rollers 31 at its pressure point as seen in FIG. 1*a*.

What is claimed is:

1. In apparatus for establishing a continuous longitudinal compressive treatment of a running length of flexible material by pressing it by means of a pressing assembly into driven engagement with a moving drive surface, the pressing assembly providing a confining surface and a retarding surface both opposed to the drive surface and the retarding surface positioned beyond the confining surface so that the material passes between the retarding and drive surfaces after it exits from beneath the confining surface, and wherein the pressing assembly comprises a presser member and coupling means for transmitting the force of the presser member to the material and the coupling means comprises confining means defining the confining surface, retarding means positioned at least in part beyond the confining means and defining the retarding surface and force transmitting means between the presser member and the confining and retarding means, the improvement wherein:

said presser member and coupling means are mounted for movement relative to each other longitudinally of the moving drive surface, means are provided for effecting such relative movement while said presser member is in pressing engagement with said coupling means, and said coupling means are so disposed and arranged with respect to said presser member as during said relative movement in one direction progressively to force said retarding surface closer to said moving drive surface from a relatively remote, ineffective position to positions closer to said drive surface to increase progressively the retarding effect of the retarding surface on a material driven by said drive surface, and during said same relative movement to transmit sufficient force to the confining surface to maintain material beneath it in non-slipping, driven engagement with said drive surface to the vicinity of the commencement of said retarding surface.

2. The combination of claim 1 wherein said confining means is so disposed and arranged as to maintain the material in non-slipping, driven engagement with the drive surface to a point O close to but spaced slightly in advance of the beginning point M of the retarding surface, and said confining means also defines a confining surface which extends from points O to M and which is disposed and arranged to slippably confine the material to a restricted thickness such that the delivery of the material by the moving surface to point O forces the material to immediately compress in its own plane against a confined column of compressed material prior to reaching said retarding surface.

3. The combination of claim 2 wherein said retarding means defines a retarding surface comprising a multiplicity of material gripping projections operable to have an aggregate retarding effect as they are held in contact with the material.

4. The combination of claim 3 wherein said retarding means defining said retarding surface comprises an inextensible layer member projecting over said drive surface.

5. The combination of claim 4 wherein a backing layer of resilient material lies over said retarder layer member and comprises part of said coupling means.

6. The combination of claim 4 wherein said confining means comprises a sheet form primary member and said layer member has a rearward portion lying over said primary member.

7. The combination of claim 6 wherein said retarding means is backed by a layer of a material which is resiliently deformable in the direction of the thickness of said primary member, extending over the latter and forming part of said coupling means.

8. The combination of claim 1 wherein the spacing of the confining surface from said movable drive surface, immediately preceding said retarding surface, is greater than the spacing of ssaid confining surface in advance thereof, enabling expansion of the material in the direction of its thickness before reaching said retarding surface.

9. The combination of claim 1 wherein said member presser is movable between a position in which its force is transmitted to said confining means and a position in which its force is transmitted to said retarding means.

10. The combination of claim 9 wherein said presser member and said coupling means are in mutually slidable engagement.

11. The combination of claim 1 wherein said presser member carries rollers engaging said coupling means.

12. The combination of claim 1 wherein said confining and retarding means are interconnected and movable in unison with respect to said presser member.

13. The combination of claim 12 wherein said moving drive surface moves about an axis and the direction of movement of said confining and retarding means is substantially tangent to said moving drive surface.

14. The combination of claim 13 wherein said confining and retarding surfaces lie in substantially parallel planes, the plane of the confining surface being closer to said drive surface, said confining surface in the relatively ineffective position of the retarding surface extending beyond a tangent point with said drive surface.

15. The combination of claim 13 wherein said coupling means includes a pressing plate adapted to press said confining means and retarding means toward said drive surface, said coupling means being movable backward, moving the beginning point M of the retarding surface toward said point of tangency.

16. The combination of claim 15 wherein an elastomeric layer is disposed between said pressing plate and said confining and retarding means.

* * * * *